United States Patent [19]

Mitter

[11] 4,195,567

[45] Apr. 1, 1980

[54] STENCIL PRINTING APPARATUS

[76] Inventor: Mathias Mitter, Falkenstrasse 57, 4815 Schloss Holte, Fed. Rep. of Germany

[21] Appl. No.: 836,477

[22] Filed: Sep. 26, 1977

[30] Foreign Application Priority Data

Sep. 25, 1976 [DE] Fed. Rep. of Germany ..... 2643226

[51] Int. Cl.[2] ..... B41F 15/10; B41F 15/24; B41F 15/36; B41F 15/42

[52] U.S. Cl. ..... 101/115; 101/123; 101/126; 101/127.1; 101/48

[58] Field of Search ..... 101/123, 124, 126, 48, 101/127.1, 56, 128.1, 47, 48, 49, 50, 51, 52, 53, 54, 55, 56, 57, 58-65, 114, 115; 312/267, 268; 271/3.1, 157

[56] References Cited

U.S. PATENT DOCUMENTS

| | | | |
|---|---|---|---|
| 1,606,358 | 11/1926 | Geiger et al. | 101/48 |
| 1,883,643 | 10/1932 | Elliot | 101/48 |
| 2,206,176 | 7/1940 | Foard | 101/126 |
| 2,710,577 | 6/1955 | Prett | 101/124 |
| 3,780,652 | 12/1973 | Black et al. | 101/124 |
| 3,883,203 | 5/1975 | Lexe | 312/268 |
| 3,905,293 | 9/1975 | See et al. | 101/56 |

*Primary Examiner*—J. Reed Fisher
*Attorney, Agent, or Firm*—Michael J. Striker

[57] ABSTRACT

A stencil printing apparatus for printing a workpiece web at a printing station has a support on which the workpiece web is to be located so that a pattern can be printed on it in a plurality of successive printing operations. A magazine is located above the support at the printing station and accommodates a plurality of vertically stacked flat-screen stencils, and an arrangement is provided for serially withdrawing some or all of the stencils from the magazine, moving them to printing position above the workpiece web, and then returning them serially back to the magazine.

11 Claims, 9 Drawing Figures

66
6
64
71
71
30
7
62
244
4
76
30
3
168
164
275
361
61
70
63
275
60
12
361
111
40
5
1
211
61
41
42
9
8
2
11
311
10
2

STENCIL PRINTING APPARATUS

BACKGROUND OF THE INVENTION

1. Field of the Invention

The present invention relates to a printing apparatus in general, and in particular to a stencil printing apparatus.

Still more specifically, the invention relates to a stencil printing apparatus for printing on a workpiece web in a plurality of printing operations.

2. The Prior Art

It is known from the prior art, for example from German allowed application DT-AS No. 1,252,167, to provide a flat-screen stencil printing apparatus which prints on workpiece webs that are transported stepwise so that each increment is printed subsequent to the preceding transporting step. This apparatus may be so constructed that it uses a plurality of printing stencils each of which prints a different color pattern onto the workpiece. The stencils are arranged one behind the other along the length of the transporting path for the workpiece, i.e. each stencil in effect constitutes a separate printing station. It is evident that such an apparatus must be rather long in the direction of workpiece travel since each printing station (for the respective stencil) requires a certain minimum amount of space. In the case of certain difficult mixed-color printing operations it may be necessary to use as many as twelve successively arranged stencils, and hence to have a corresponding number of printing stations. The overall length of the machine will then of course be tremendous, a condition which is unacceptable in many applications where space for the installation of the machine is at a premium. Furthermore, it has been observed that as the workpiece web is transported from a preceding printing station (at which one color of the final pattern has been printed on it) to a succeeding printing station (at which another color of the pattern is to be printed on it) there tends to be a certain distortion (due to pulling or other factors) in the structure of the workpiece web, especially if the same is a textile, so that a precise print-over of the second color onto the previously printed first color becomes impossible. Particularly if the workpiece web is a heavy-quality textile or the like, there is not only a pulling of the individual threads to be observed, but also the lateral edges (extending parallel to the direction of web movement) tend to be pulled somewhat inwardly towards the center of the web. These problems become the more pronounced, the heavier the web and/or the more delicate it is, making it extremely difficult if not entirely impossible to print with each successive stencil in precise register relative to the preceding printing.

SUMMARY OF THE INVENTION

Accordingly, it is an object of the present invention to overcome the disadvantages of the prior art.

More particularly, it is an object of the present invention to provide an improved stencil printing apparatus which is capable of printing two or more colors at one and the same printing station.

Another object of the invention is to provide such an improved stencil printing apparatus which is of rather small dimensions since it requires only a single printing station.

In keeping with these objects, and with others which will become apparent hereafter, one feature of the invention resides in a stencil printing apparatus printing a workpiece web at a printing station. Briefly stated, this apparatus may comprise support means for supporting at the printing station a workpiece web onto which a pattern is to be printed in a plurality of successive printing operations, and a magazine adjacent the support means at the printing station. A plurality of flat-screen stencils is located in the magazine and each of these is provided with at least part of the pattern to be printed. Means are provided for successively transferring the respective stencils from the magazine to a printing position in which the stencil is located above the workpiece web for printing onto the same, and successively back into the magazine.

An apparatus constructed in accordance with the present invention makes it possible to move the respectively required stencil out of the magazine to the printing position, to print with the stencil onto the workpiece web, remove the stencil and replace it with another one from the magazine and to print with a different color onto the workpiece web but still at the same printing station as before. Any desired number of printing stencils can be utilized in this manner. Of course, the term "workpiece web" as used herein refers to any kind of sheet material that can be stencil printed, for example paper, synthetic plastic foils, textiles, rugs, carpets or the like. The term "stencil" as used herein refers to any type of flat-printing equipment, i.e. printing screens, film stencils or the like.

According to a currently preferred embodiment of the invention the magazine will be located at a level above the workpiece supporting surface of the support means and be provided with a raising and lowering device for the individual stencils. The magazine may be located directly over the web supporting surface, and the same is true of the raising and lowering device. Locating the magazine above the supporting surface has the advantage that only a minimum amount of time is lost when one stencil is exchanged for another, since the stencil which is being replaced need merely be moved laterally out of the printing position after it has been raised to avoid smearing of the print, is then moved upwardly and into the magazine at a desired location, and is replaced with another stencil that is moved in the reverse direction. The arrangement can of course be such that the stencils are circulated seriatim, i.e. that always the lowermost stencil in the magazine is the one that is put in printing position whereas the stencil that has just been removed from the printing position is placed in the magazine at the top of the stack and the stack is lowered stepwise as each stencil is withdrawn from the bottom of the magazine.

The present invention makes it possible to print any desired number of colors or combinations of colors with the workpiece web remaining absolutely stationary until the complete printing job is completed; only thereafter is the workpiece web transported forwardly by a distance sufficient to place another increment at the printing station to be printed again with a desired number of colors.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
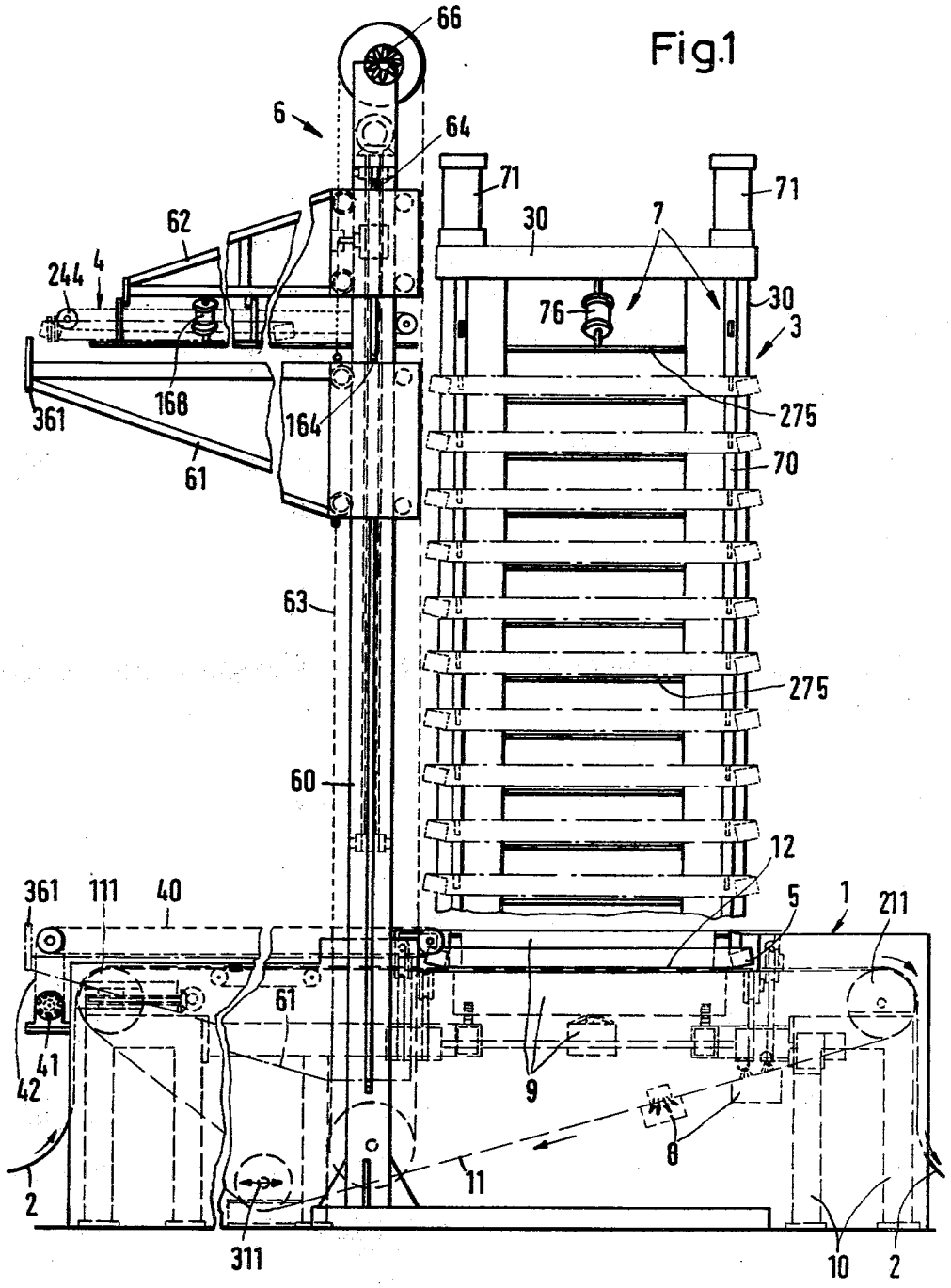
FIG. 1 is a somewhat diagrammatic side-elevational view of a stencil printing apparatus according to the present invention, with the magazine located above the level of the workpiece supporting surface.

Discussing now the drawing in detail, and referring firstly to FIG. 1, it will be seen that the apparatus 1 according to the present invention has a frame 1 to which the workpiece web to be printed (identified with reference numeral 2) is supplied as indicated by the arrow at the left-hand side of the Figure. As mentioned before, the workpiece web 2 may be a fabric, paper, textile, synthetic plastic foil, metallic foil or the like, and of course it could be in form of individual sheets which are supplied seriatim as well as in form of an elongated continuous band.

An endless screen band 11 (which could also be in form of a printing blanket) is mounted in the machine frame 10 to travel about a reversing roller 211, a tensioning roller 111, and a tension-regulating roller 311 which is movable in the direction indicated by the double-headed arrows so as to regulate the tension of the band 11. The decision whether a screen band or a conventional printing blanket should be used depends upon the type of squeegee arrangement that is to be employed. Reference numeral 12 identifies the print plane, i.e. the plane in which the workpiece web 2 is advanced through the printing station to be printed upon. In the embodiment of FIG. 1 a stencil magazine 3 is located above the plane of the printing station, and in fact above the upper surface of the upper (workpiece-supporting) run of the band 11. Vertically stacked in the magazine 3 is a plurality of flat-screen stencils 5 which are known per se.

Laterally adjacent the magazine 3 is a raising and lowering device 6 which serves to engage whichever one of the stencils 5 has just been used for printing and which has first been lifted off the workpiece web 2 and has been moved laterally out of the printing position (towards the left in FIG. 1); the device 6 transports this stencil 5 upwardly and reinserts it into the magazine 3. It comprises uprights 60, a lower carriage 61 and an upper carriage 62 which receives the respective stencil 5 and reinserts it into the magazine 3. Both of the carriages 61 and 62 can be raised and lowered along the uprights 60 so that their position in vertical direction with reference to the magazine 3 can be adjusted.

A motor-driven endless chain 63 is connected to the lower carriage 61 to raise and lower the same so that, when the just-printed stencil 5 has been moved onto the carriage 61 the latter raises it to the vicinity of the upper carriage 62 which is positioned at a level relative to the magazine 3 at which the just-printed stencil 5 is to be reinserted into the magazine. The level of the upper carriage 62 can be adjusted by means of an adjustable abutment 64 and a screw spindle 65 which adjusts the abutment and which will be described subsequently in connection with FIGS. 8 and 9. Another abutment 164 is provided for the lower carriage 61 and is advantageously constructed as a limit switch, so that the position of the lower carriage 61 with reference to the upper carriage 62 can be precisely predetermined.

The upper carriage 62 is provided with a horizontal conveyor 4 which in the illustrated embodiment serves only the purpose of inserting the just-printed stencil 5 into the magazine. Because of this a second horizontal conveyor 40 is provided adjacent the printing plane 12 and serves to pull the just-printed stencil 5 out of the printing position and to the lower carriage 61. However, it should be understood that it would be possible to omit the conveyor 40 and utilize only the horizontal conveyor 4 if the same were for example provided on the lower carriage 61 to move up and down with the same. The dual-conveyor embodiment shown in FIG. 1 has the advantage, however, of saving time in the exchange of one stencil for another, since during the time interval during which the conveyor 40 pulls the just-printed stencil 5 out of the printing position the conveyor 4 can insert the previously printed stencil 5 into the magazine 3 so that no time is lost.

FIG. 1 also shows diagrammatically an arrangement 8 for washing and drying the workpiece supporting band 11 so as to remove from it any printing ink or other printing medium that might adhere to it. Also shown diagrammatically is the squeegee arrangement 9 which comprises a squeegee located above the stencil 5 that is respectively in the printing position and a suction device located beneath the upper workpiece-supporting run of the band 11 to draw printing medium through the stencil 5 into the workpiece on the upper run of the band 11. Such squeegee arrangements operating on this principle are known and form no part of the invention; therefore, they are not described in detail. The magazine 3 has a frame 30 provided with four corner uprights each of which is associated with the raising and lifting devices 7 for moving the stencils 5 located within the magazine 3. It also includes a centering device, and details of these devices will be described subsequently with respect to other Figures.

Figure 2:
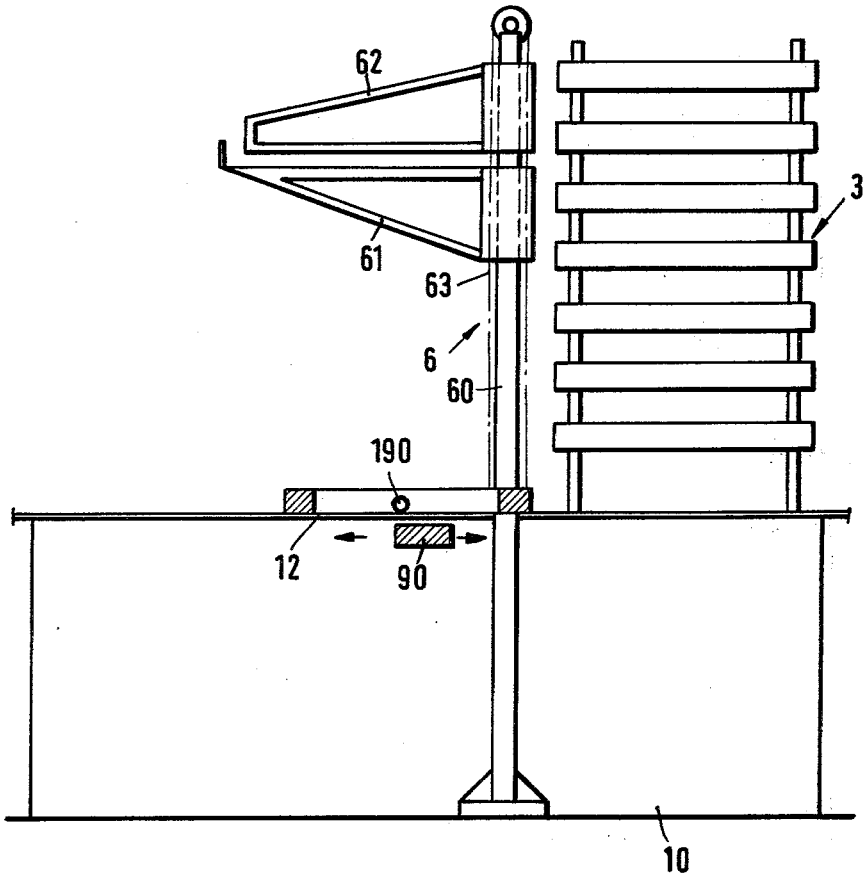
FIG. 2 is a simplified end view of an apparatus similar to the one in FIG. 1, but having the magazine located laterally of the workpiece supporting surface.

The embodiment in FIG. 2 differs from the one in FIG. 1 only in that the magazine 3 is located laterally of the workpiece-supporting band 11, rather than being located immediately above it as in FIG. 1. Hence, in FIG. 2 the raising and lowering device 6 must be located directly over the workpiece supporting surface; as in the case of FIG. 1 it comprises uprights 60, the lower carriage 61 and the upper carriage 62. In this embodiment, as indeed in any other embodiment, the squeegee arrangement 9 of FIG. 1 can be replaced with a magnetic squeegee arrangement having a squeegee roller 190 located above the stencil 5 that is respectively located in the printing position and a magnet 90 (e.g. an electromagnet) which is located below the workpiece supporting run of the band 11 and which can be moved by a suitable drive (conventional and therefore not illustrated) in the direction of the double-headed arrow so as to pull along the squeegee roller 190. Of course, instead of moving the magnet 90 left and right as shown in FIG. 2, and hence imparting similar movement to the squeegee roller 190, the movement could be in direction normal to the plane of FIG. 2 if desired, or a composite movement might be imparted to the squeegee roller 190.

Figure 3:
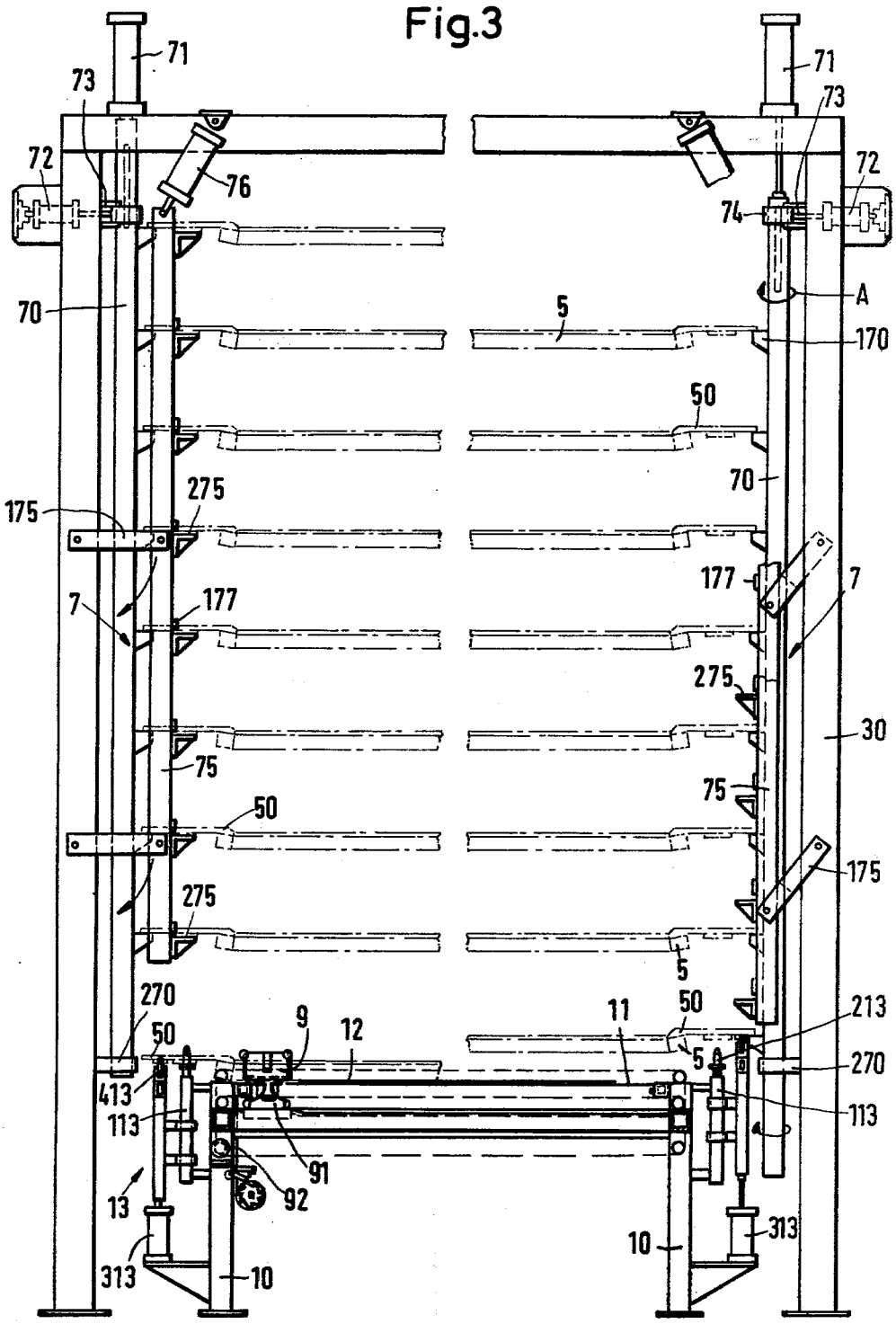
FIG. 3 is a somewhat diagrammatic vertical section through the magazine.
Figure 4:
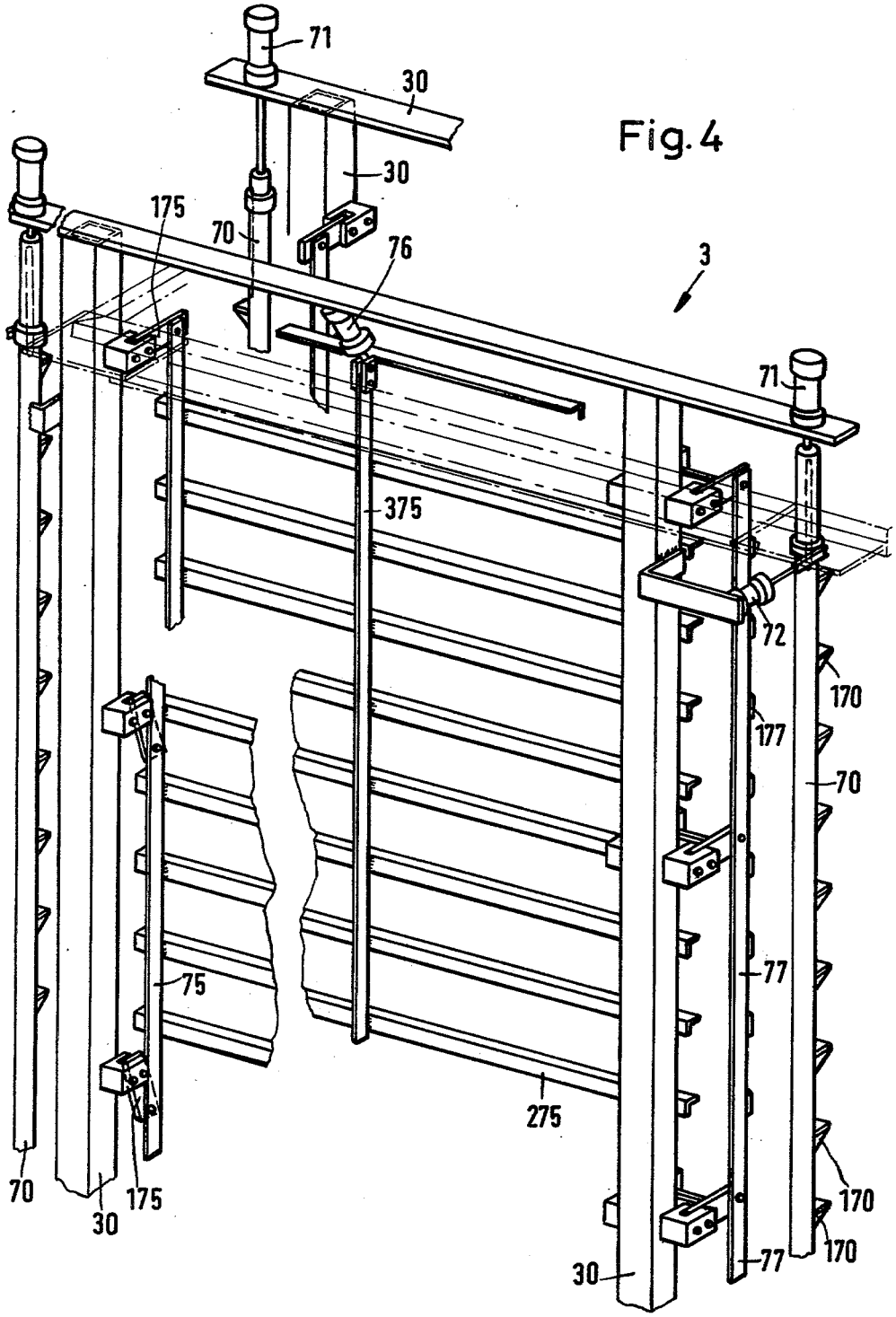
FIG. 4 is a fragmentary, partly broken away perspective view of the magazine, showing portions of the associated equipment in different operating positions at the left and righthand side, respectively.

FIGS. 3 and 4 illustrate the magazine in more detail. It will be seen to have the earlier-mentioned frame 30 which in the context of the embodiment of FIG. 1 straddles the machine frame 10. At the right-hand side of FIG. 4 the stencils 5 are shown in lifted position, ready either for direct lowering to the working position as shown in FIG. 3, or in readiness for withdrawal from the magazine. Opposite sides of the stencils 5 are provided with projecting lugs 50 which are arranged in pairs; their purpose is to provide for engagement by the device 7 and also to assure exact centering of the stencils 5 in the working position. Raising and centering of the stencils 5 is effected by a device 113 is provided with guide pins 213 that can be adjusted in their height. A receiver can be raised and lowered by means of cylinder-and-piston units 313 whose piston rods are provided with rollers 413 on which the lugs 50 rest so that the stencils 5 can be pulled into and out of the magazine 3 on these rollers.

In the embodiment shown in FIG. 3 the squeegee arrangement 9 utilizes a suction-type arrangement. Thus, the workpiece support is in form of a permeable screen or sieve-band 11 on top of which the workpiece is supported and below which a protective cloth 92 may be arranged which protects the band 11 against direct contact with the suction box of the squeegee arrangement, which suction box is located beneath the upper workpiece-supporting run of the band 11 and serves to draw printing medium through the respective stencils 5 and into the workpiece.

The means for raising and lowering the stencils 5 comprises at least one pair of devices identified with reference numeral 7 and located within the magazine 3. Each device has a rod or upright bar 70 (FIGS. 1 and 3) which can be moved vertically by means of cylinder-and-piston units 71 and which is provided with carriers 170 (FIG. 3) which are arranged vertically spaced at uniform distances and which are adapted to support the stencils 5 by engaging the lugs 50 thereof. In addition to being vertically movable the rod 70 can also be turned about its vertical axis so that the carrier 170 can be pivoted out of the range of movement of the lugs 50, as indicated by the arrow A at the right-hand side of FIG. 3. The pivoting movement is imparted to the rod 70 by means of cylinder 72 which engages a lever 73 (compare FIG. 5). Of course, there is more than one of the rods 70 provided, and these are located in the corner regions of the frame 30 of the magazine 3. To permit movement up and down and at the same time a pivoting of the rods 70 as described before, each of the rods is provided with a ring 74 which embraces the respective rod to which it is connected (e.g. by a tong-and-groove connection). The ring is also connected to the lever 73 so as to be turnable by the same, and it permits sliding of the rod 70 in vertical direction. It should be noted that the right-hand side of FIG. 3 shows one of the rods 70 in lowered position whereas the left-hand side of FIG. 3 shows a rod in raised position, and that the guides 270 guide the rods for such movements.

Each corner upright of the frame 30 of the magazine 3 also is provided with an arrangement for connection of a so-called magazine comb 75, each of which is pivotally connected to lugs 175 and engaged by pivotally mounted cylinder 76 which makes it possible to raise and lower the respective comb 75 which moves with the lugs 175 in a parallelogram relationship relative to the corner uprights of the frame 30.

FIG. 4 shows the individual components more clearly in relationship to one another. It also shows that each of the combs 75 is provided with glide rails 275 on which the lugs 50 of the respective stencils 5 can be pushed along. FIG. 4 also shows that the inclined pivotally mounted cylinders 76 engage and move the comb 75 via a center bar 375 thereof.

Figure 5:
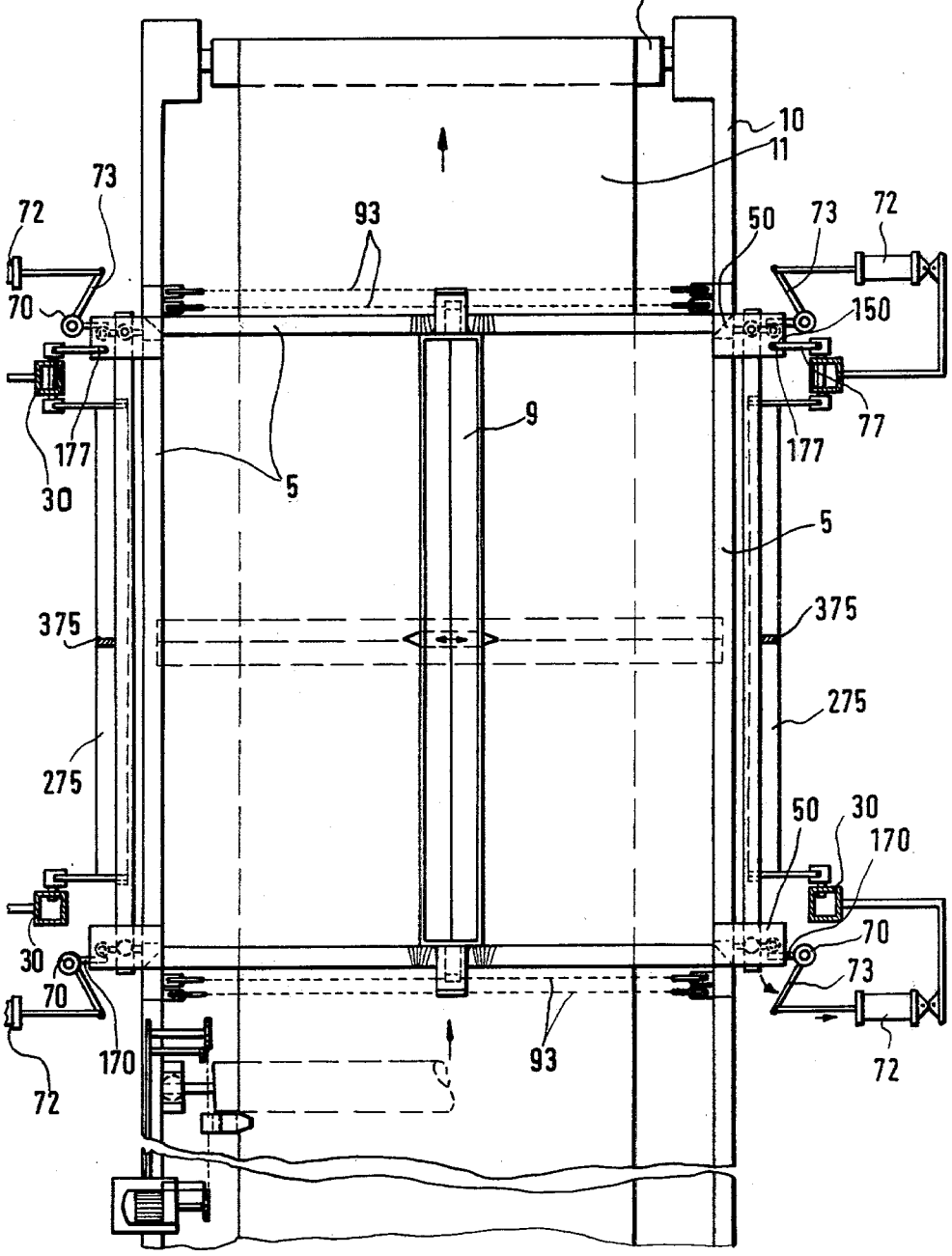
FIG. 5 is a diagrammatic top-plan view of the printing station of an apparatus according to the present invention.

A precentering rail 77 is also provided in the magazine 3 and engages in recesses 150 of the lugs 50, as shown in FIG. 5. The precentering rail 77 may be provided with precentering members 177 which can engage in these recesses 150. It should be noted, however, that the precentering rail 77 with its members 177 could be omitted if desired.

The arrangement of the rods 70 in relationship to the corner uprights of the magazine frame 30 is most clearly shown in FIG. 5, where it will also be seen how the members 177 of the precentering rail 77 are located, and how the cylinders 72 are mounted and how the piston rods of the cylinders 72 cooperate with the respective lever 73 in order to make pivoting of the carriers 170 possible.

The Operation

In the operation of the apparatus according to the present invention, and assuming that a stencil 5 is in the printing position as shown, e.g. in FIG. 1, this stencil will be raised slightly off the workpiece to avoid smearing of the print thereon, and will then be moved out of the printing position (e.g. left in FIG. 1). This is effected by the device 30, particularly the rollers 413 and before such leftward movement can occur the stencil 5 will have become disengaged from the centering pins 213 which normally hold it during the printing operation. The stencil 5 then comes to rest on the carriage 40 and the two combs 75 are lowered after the rod 70 has first been moved so that its carriers 170 engage the lugs 50 from below. The stencils 5 now rest no longer on the glide rails 275 but only on the carriers 170 and when the cylinder 71 is then operated the rods 70 are lowered so that all of the stencils in the magazine are uniformly lowered by an identical distance. The lowermost stencil 5 in the magazine becomes deposited on the receiving and centering arrangement 13, to rest on the rollers 413 of the same at the position shown in FIG. 3 on the right-hand side. The comb 75 provided with the glide rails 275 is now moved to closed position and engages all of the stencils 5 except for the one which is at this time located in the printing position. It is then pivoted laterally outwardly and raised by operation of the two cylinders 76, whereupon it is pivoted back into its working position. The lowermost stencil 5 is now located in the operating or printed position on the workpiece that is supported on the upper run of the band 11. All other stencils 5 are maintained in position by the glide rails 275 which have received the stencils from the rods 70 due to the outward pivoting of the carriers 170 thereof, namely all those stencils 5 which are not in printing position. When the rods 70 are lowered with all of the stencils 5 by one step, i.e. each stencil is moved downwardly by one step and the length of the step is uniform for all of the stencils, then the stencils waiting to be moved to printed position each move—during subsequent transfer to the glide rails 275—to the next-lower glide rail so that they have thus been transported down by one step.

The stencil 5 that is in printing position (see right-hand side of FIG. 3) is at this time resting on the rollers 413 and moves into final position by lowering the four corner cylinders 313 so that at the four corners the centering pins 213 enter into the corresponding openings of the lugs 50. The stencil 5 is now immovably held in printing position and the squeegee arrangement 9 can operate upon it. Of course, it would be conceivable to use only two of the centering pins 213, if desired.

When the squeegee arrangement 9 has completed the squeegee operation (known per se and therefore not described) a rope drive 93 (FIG. 5) or other suitable arrangement moves the squeegee to a lateral position in which it is no longer located over the stencil 5 that is being printed. The stencil 5 can now be raised and moved laterally by the conveyor 40, the raising being effected by upwardly extending the cylinders 313 so that the stencil becomes disengaged from the centering pins 213 and can be pulled out of its printing position while resting on the rollers 413. For this purpose a finger is provided on the chain of the horizontal conveyor 40 which during movement of the chain engages the stencil 5 and pulls it out of printing position with the conveyor 40. Of course, the chains of the conveyor 40 are located both at the left-hand and at the right-hand side of the machine so as to uniformly pull the stencil 5 out of the printing position. The conveying or transporting chains of the conveyor 40 are driven by a motor 41 via a chain 42 as shown in FIG. 1. The stencil 5 is now in rest position until it is raised by the lifting arrangement 6.

Figure 6:
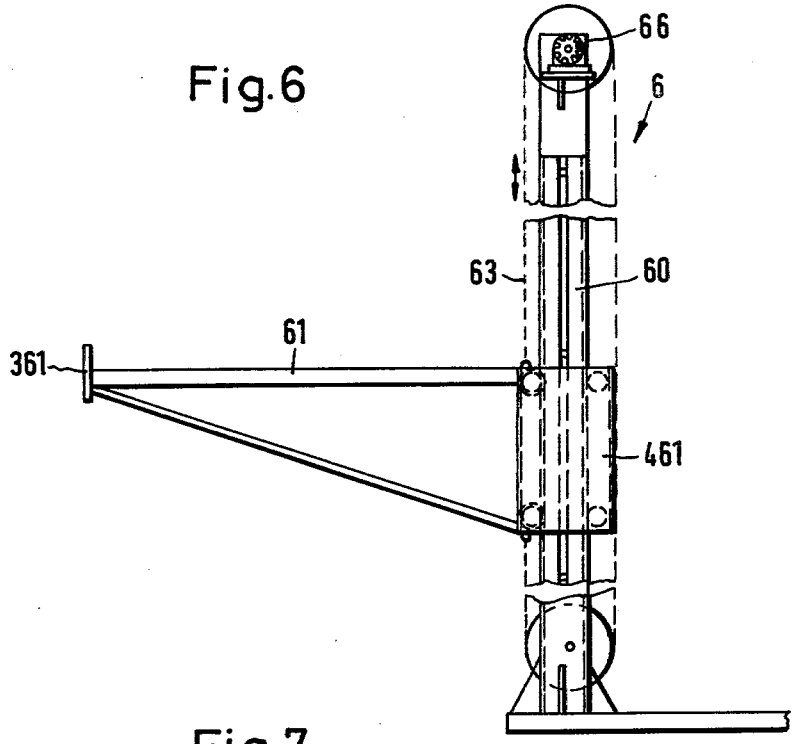
FIG. 6 is a side view showing the lower carriage associated with the magazine of an apparatus according to the present invention.
Figure 7:
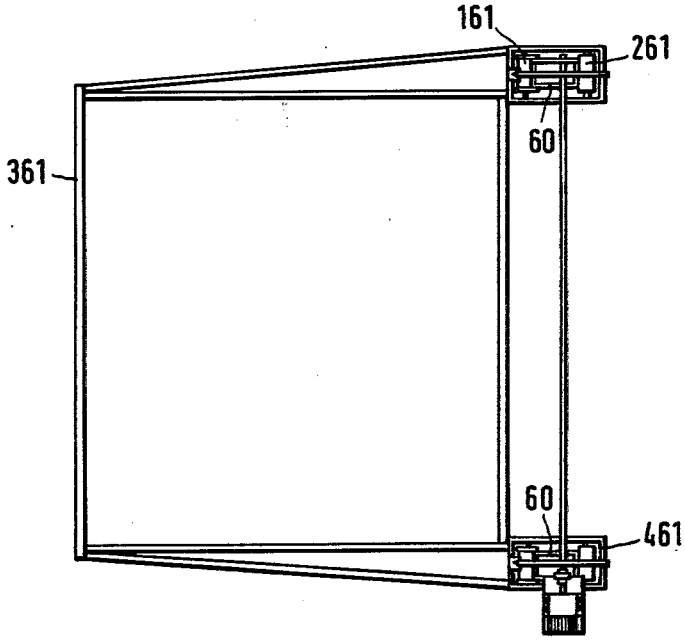
FIG. 7 is a top-plan view of FIG. 6.

Details of the lifting arrangement 6 are shown in FIGS. 6, 7, 8 and 9. Of these, FIGS. 6 and 7 show the lower carriage, it being understood that both of the carriages 61 and 62 can move vertically on the upright 60. The upper carriage 62 is shown in detail in FIGS. 8 and 9 and can be mounted in a fixed position instead of being vertically movable on the upright 60, if always the number of stencils is to be printed. If, however, sometimes more and sometimes fewer of the total number of stencils in the magazine is to be printed, then the upper carriage 62 must also be vertically movable. It can also be vertically movable if the stencils are to be selectively usable, for example if different stencils are to be selected in dependence upon the particular color or color combinations to be printed.

The lower carriage 61 embraces the upright 60 and is guided on rollers 161 and 261, and the chain 63 which is mounted on the lower carriage 61 and driven by a motor 66, moves in an endless path in vertical direction as shown in FIG. 6. The lower carriage 61 must move to the lowermost position (shown in broken lines in FIG. 1) before the stencil 5 that has just been printed is pulled out of its operating or printing position by the horizontal conveyor 40 so that this stencil then comes to rest on the lower carriage 61 which in effect acts as a pallet support. The just-printed stencil 5 comes to rest when it engages an abutment 361, as shown in broken lines in FIG. 1 and the lower carriage 61 is then raised until it engages the limit switch 164 and thus shuts off the motor 66. The rollers 161 are located in a casing 461. The upper carriage 62 is guided in principle in the same manner as the lower carriage 61, having rollers 162 and 262 which engage and embrace the upright 60 and are located in a casing 462. The movement of the upper carriage 62 is effected in a somewhat different manner, namely by means of a spindle drive which is driven by a motor 67 via pairs of bevel gears 167 and a shaft 267. Two spindles 65 are provided which are so driven and are embraced by spindle nuts 165 which in turn are mounted on the uprights 60. Thus, the motor 67 is the control motor for the movement of the upper carriage 62.

Figure 8:
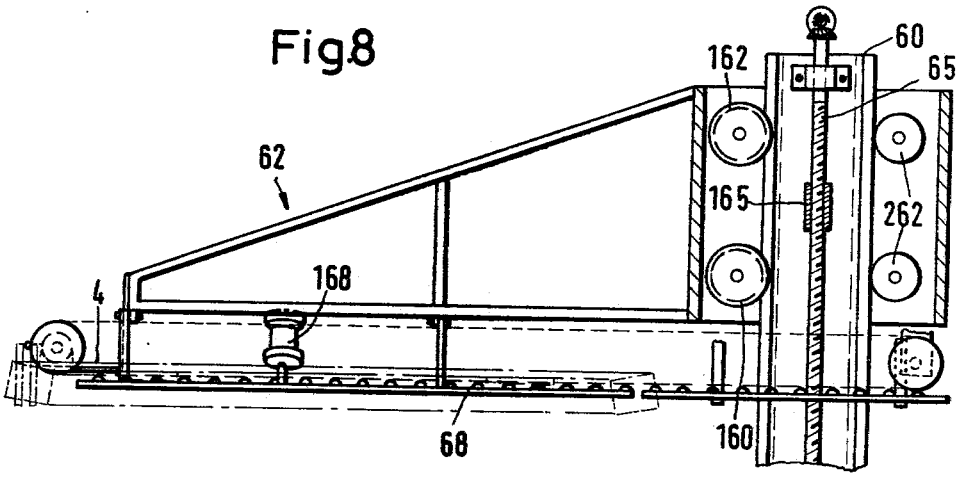
FIG. 8 is a view analogous to the one in FIG. 6, showing in more detail and partly in section the upper carriage associated with a magazine in an apparatus according to the present invention.
Figure 9:
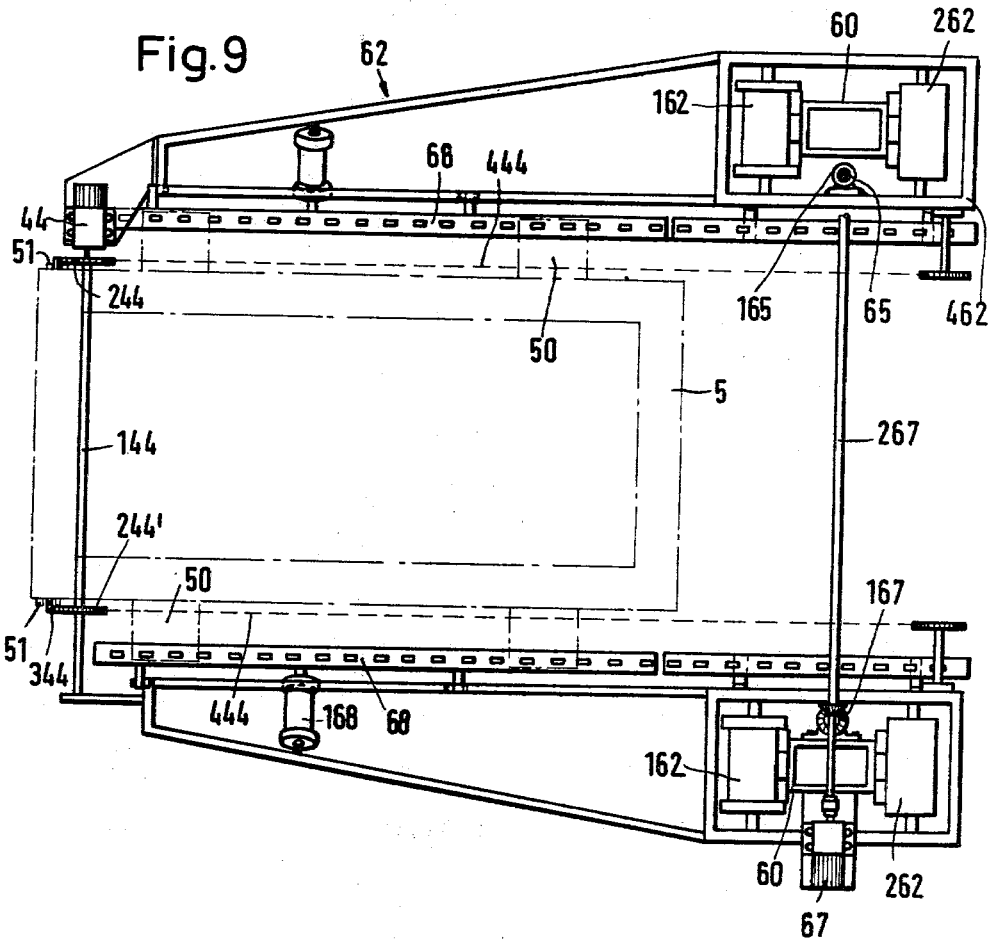
FIG. 9 is a top-plan view of FIG. 8.

The just-printed stencil 5 which has been moved upwardly by the lower carriage 61 is received by the upper carriage 62, rails 68 of which extend beneath the lugs 50 thereof. The rails can be partially pivoted up and down by cylinders 168. When the carriage 61 moves upwardly the rails 68 are pivoted downwardly and when the carriage 62 is to receive the stencil 5 carried by the lower carriage 61, the cylinders 168 are operated to pivot the sections of the rails 68 upwardly and underneath lugs 50 so that the stencil 5 is then supported in the upper carriage 62, as shown in FIGS. 8 and 9. The upper carriage 62 is located at the position at which the stencil 5 is to be inserted into the magazine 3. Its horizontal conveyor 4 utilizes a motor 44 which is mounted on the upper carriage 62 and which drives via a shaft 144 two sprockets 244, 244'. These entrain a pair of endless chains 444 each of which is provided with a finger 344 that engages during the advancement of the chains 444 into a recess 51 of the stencil 5 so that the stencil then is transported by the chains 444 (while resting on the rails 68) until it moves onto the glide rails 275 opposite the position of the carriage 62 and enters the magazine 3.

The position of the limit switch 64 can be varied up and down so that the uppermost end position of the carriage 62 can be predetermined by prepositioning the limit switch 64 in the appropriate manner.

The invention as disclosed is susceptible of various modifications which are intended to be encompassed within the protection sought in the appended claims. For example, and as already indicated and mentioned in connection with the embodiment in FIG. 2, the magazine 3 can be located laterally of the workpiece supporting run of the band 11, instead of being directly over it. In this case the lifting arrangement 6 will be located over the upper run, i.e. over the printing plane, but the embodiment in FIG. 1 has the advantage that the respectively lowermost stencil 5 in the magazine 3 will be immediately lowered into printing position and be ready for the squeegee operation so that no time is wasted moving it into position, because during the lowering of a respective stencil 5 into printing position the lifting arrangement 6 shown at the left-hand side of FIG. 1 can already be operating to remove the previously printed stencil 5 and return it into the magazine 3. In this embodiment, therefore, the operations print, upward conveying of a previously printed stencil and reinsertion of the previously printed stencil into the magazine 3, are therefore independent of one another.

If the stencils 5 are not to be continuously circulated into and out of the magazine 3, i.e. if they are not to be sequentially withdrawn and sequentially reinserted, then it is possible to leave certain spaces in the magazine 3 free and to control the movement of the upper carriage 62 in such a manner that it inserts the stencils 5 which are to be printed out of sequence, into these left-free spaces in the magazine.

While the invention has been illustrated and described as embodied in a stencil printing apparatus for printing a workpiece web, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Stencil printing apparatus for printing a workpiece web at a printing station, comprising support means for supporting at the printing station a workpiece web onto which a pattern is to be printed in a plurality of successive printing operations; a magazine adjacent said support means at the printing station; a plurality of flat-screen stencils in said magazine and each provided with at least part of the pattern to be printed; and transferring means for successively transferring the respective stencils from said magazine to a printing position in which the stencil is located above the workpiece web for printing onto the same, and subsequently back into said magazine, said transferring means comprising a raising and lowering device for said stencils, including upright support means adjacent said magazine, an upper and a lower stencil-supporting carriage movable along said upright support means, means for mounting said carriages for movement along said upright support means, and conveying means on at least one of said carriages for substantially horizontally moving respective stencils between said magazine and said at least one carriage.

2. Apparatus as defined in claim 1; further comprising additional conveying means for transferring respective stencils between said lower carriage and said printing position.

3. Apparatus as defined in claim 1, said conveying means being provided on said upper carriage and comprising a horizontally advancing chain and sprockets about which said chain is trained, and at least one engaging portion on said chain which advances with the same and engages the respective stencils.

4. Apparatus as defined in claim 1, said stencils having laterally projecting lugs, and said upper carriage having movable rails which are engageable beneath the lugs of the respective stencils to support the stencils from below.

5. Apparatus as defined in claim 1, said device further comprising screw-spindle drive means operatively connected with said upper carriage for raising and lowering the same on and relative to said upright support means.

6. Apparatus as defined in claim 1, said device comprising rollers mounting said carriages in cantilevered relationship on said upright support means for raising and lowering relative thereto.

7. Apparatus as defined in claim 1; and further comprising adjustable stops for varying the levels to which said carriages can be raised and lowered, respectively.

8. Stencil printing apparatus for printing a workpiece web at a printing station, comprising support means for supporting at the printing station a workpiece web onto which a pattern is to be printed in a plurality of successive printing operations; a magazine adjacent said support means at the printing station and comprising a frame structure including uprights located at respective corners of said frame structure; a plurality of flat-screen stencils in said magazine and each provided with at least part of the pattern to be printed; and transferring means for successively transferring the respective stencils from said magazine to a printing position in which the stencil is located above the workpiece web for printing onto the same, and subsequently back into said magazine, said transferring means comprising at least one pair of stencil lifting and lowering devices in said frame structure and said devices each comprising at least one upright bar provided with at least one carrier, said carriers being arranged opposite one another, and means for displacing said bars in the axial direction thereof and also for rotating the respective bars about their upright axes between first and second angular positions in which stencils supported on said carriers are located inside and outside of said frame structure, respectively.

9. Apparatus as defined in claim 8, said devices comprising a pair of upright elements carrying glide rails which are located opposite one another, said elements being mounted on links pivoted to said uprights of said frame structure, and means for effecting parallelogram movement of the respective upright elements to and from positions in which they permit axially downward displacement of said upright bars.

10. Apparatus as defined in claim 8, said devices comprising cylinder-and-piston units coupled with said upright bars for effecting the displacement thereof.

11. Apparatus as defined in claim 8; further comprising centering rail means mounted via links on said uprights of said frame structure, comprising pairs of oppositely located centering rails and being operative for precentering the stencils in said frame structure.

* * * * *